US006215510B1

(12) United States Patent
Imai

(10) Patent No.: US 6,215,510 B1
(45) Date of Patent: Apr. 10, 2001

(54) THICK FILM TYPE THERMAL HEAD

(75) Inventor: Ryoichi Imai, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/513,202

(22) Filed: Feb. 25, 2000

(30) Foreign Application Priority Data

Feb. 26, 1999 (JP) ..... 11-049425

(51) Int. Cl.[7] ..... B41J 2/335
(52) U.S. Cl. ..... 347/200; 347/206
(58) Field of Search ..... 347/200, 206, 347/208

(56) References Cited

U.S. PATENT DOCUMENTS 4,048,470 * 9/1977 Shindo et al. ..... 347/208
5,417,156 5/1995 Tateishi et al. .

FOREIGN PATENT DOCUMENTS 0 867 288 A2 9/1998 (EP) .
063037962 2/1988 (JP) .
06135031 5/1994 (JP) .

* cited by examiner

*Primary Examiner*—Huan Tran
(74) *Attorney, Agent, or Firm*—Nixon Peabody LLP; Donald R. Studebaker

(57) ABSTRACT

A thick film type thermal head for thermally perforating a stencil material in an imagewise pattern to make a stencil is moved along the stencil material in a sub-scanning direction while energizing a plurality of heater elements arranged in an array extending in a main scanning direction. The thermal head includes an electric heater strip extending in the main scanning direction direction, and a plurality of first and second electrodes which are alternately disposed spaced from each other in the main scanning direction and extend across the heater strip in contact with the electrodes. The parts of the heater strip between adjacent first and second electrodes form the heater elements. An electrical insulating layer is disposed between the first and second electrodes and the heater strip at least on one side of the heater strip so that the width of the electrical contact area between the first and second electrodes and the heater strip becomes smaller than the width of the heater strip.

3 Claims, 6 Drawing Sheets

PRIOR ART

PRIOR ART

THICK FILM TYPE THERMAL HEAD

BACKGROUND OF THE INVENTION

1. Field of the Invention

This invention relates to a thermal head for making a stencil by thermally perforating a stencil material, and more particularly to an improvement of a thick film type thermal head.

2. Description of the Related Art

A thermal head generally comprises a heater element array formed by a plurality of heater elements arranged in a row extending in one direction (this direction is generally referred to as "the main scanning direction"), and when making a stencil, the thermal head is moved along a stencil material in a direction intersecting the main scanning direction (this direction is generally referred to as "the sub-scanning direction") while selectively energizing the heater elements, thereby thermally perforating the stencil material in an imagewise pattern. Such thermal heads are broadly divided by structure into a thin film type thermal head and a thick film type thermal head.

As shown in FIGS. 8 and 9, the thick film type thermal head conventionally comprises a ceramic substrate 85, a heat insulating layer 82 formed on the ceramic substrate 85, a plurality of comb-tooth electrodes 84 formed on the heat insulating layer 82 at predetermined intervals to extend in one direction in parallel to each other, and an electric heater strip 81 formed over the comb-tooth electrodes 84 to intersect the electrodes 84 in contact with the electrodes 84. The direction in which the electric heater strip 81 extends is the aforesaid main scanning direction and each of the parts between adjacent two electrodes 84 forms a heater element, whereby the aforesaid heater element array is formed. The main scanning direction is indicated at X in FIG. 8 and the aforesaid sub-scanning direction is indicated at Y in FIG. 8. The electric heater strip 81 is, for instance, of ruthenium oxide ($RuO_2$), and is formed, for instance, by applying ruthenium oxide solution over the comb-tooth electrodes 84 by screen printing.

In order to improve recording density, the perforating pitch (that is, the distance by which the thermal head is moved in the sub-scanning direction at one time) should be as small as possible, and in order to reduce the perforating pitch, the width (the dimension as measured in the sub-scanning direction Y) of the heat generating area of the heater strip 81 (or each of the heater elements) should be as small as possible.

That is, if the width of the heat generating area of the heater strip 81 is larger than the perforating pitch, the perforations formed side by side in the sub-scanning direction Y will be merged with each other to form an elongated perforation as indicated at 102 in FIG. 10 (reference numeral 101 in FIG. 10 denotes a stencil material). When the perforations 102 are merged with each other into an elongated perforation, a large amount of ink flows out through the elongated perforation and an excessive amount of ink adheres to the printing paper, which can result in a phenomenon that the ink penetrates to the back side of the printing paper or the ink is seen from the back side of the printing paper. Accordingly, when the perforating pitch in the sub-scanning direction Y is to be reduced, it is necessary to reduce the width of the heat generating area of the electric heater strip 81 so that discrete perforations 102 can be formed in the sub-scanning direction as shown in FIG. 11.

In the conventional thick film type thermal head, the electric heater strip 81 generates heat over its entire width W, that is, each heat generating area or each heater element 87 has a length equal to the distance between the adjacent comb-tooth electrodes 84 and a width equal to the width W of the heater strip 81 as shown in FIG. 12. Accordingly, in order to reduce the width of the each heater element 87, it is necessary to form a narrower heater strip 81.

The heater strip 81 is generally formed by applying a paste-like mixture of, for instance, ruthenium oxide powder, glass powder and solvent by squeezing. In this case, the width of application of the paste-like mixture cannot be smaller than a mesh of the screen and the mesh of the screen cannot be smaller than the size of the particles in the paste-like mixture. As a result, it is difficult to form a narrower heater strip 81. If the particles contained in the paste-like mixture can be smaller in size, the mesh of the screen can be smaller, whereby a narrower heater strip 81 can be formed. However, the particle size is in proportion to the electric resistance of the heater strip 81 and accordingly, reduction in the particle size is limited. Further since the paste-like mixture has a certain viscosity, the mixture is kept in a limited area just after application thereof. However as the time lapses, the mixture flows and spreads outward. This phenomenon also makes it difficult to form a narrower heater strip 81.

SUMMARY OF THE INVENTION

In view of the foregoing observations and description, the primary object of the present invention is to provide a thick film type thermal head having a structure which is improved so that the width of each heat generating area or each heater element can be smaller though the heater strip is formed by use of a material and a screen which are the same as those employed in forming the conventional thick film type thermal head.

The thick film type thermal head in accordance with the present invention is characterized in that an electrical insulating layer is formed between the electrodes and the heater strip at least on one side of the heater strip so that the width of the contact area (the dimension as measured in the sub-scanning direction) between the electrodes and the heater strip becomes smaller than the width of the heater strip.

It is preferred that the electrical insulating layer be formed on both sides of the heater strip.

Further it is preferred that the electrical insulating layer be formed so that the width of the contact area between the electrodes and the heater strip becomes smaller than the perforating pitch in the sub-scanning direction.

In accordance with the present invention, the effective width of each heater element can be narrowed without reducing the width of the heater strip, and accordingly, the recording density can be increased without encountering the aforesaid difficulties in reducing the width of the heater strip and without fear that the perforations are merged into an elongate perforation.

DESCRIPTION OF A PREFERRED EMBODIMENT

Figure 1:
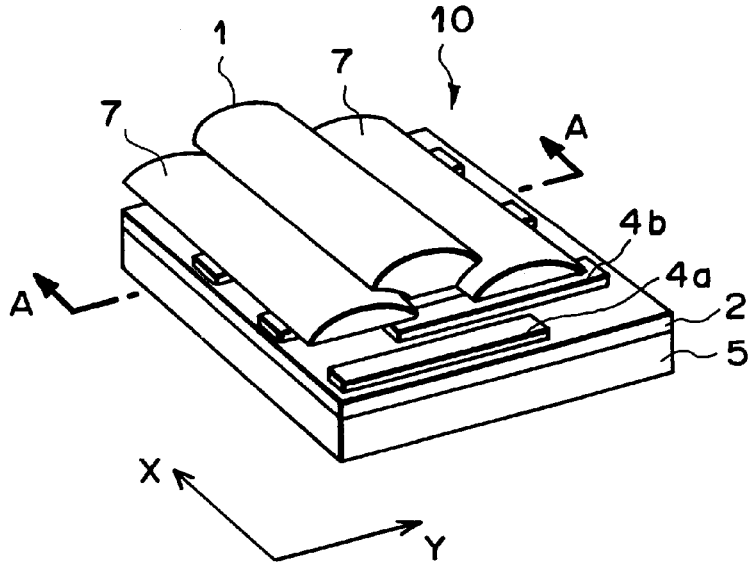
FIG. 1 is a perspective view showing a thick film type thermal head in accordance with an embodiment of the present invention.
Figure 2:
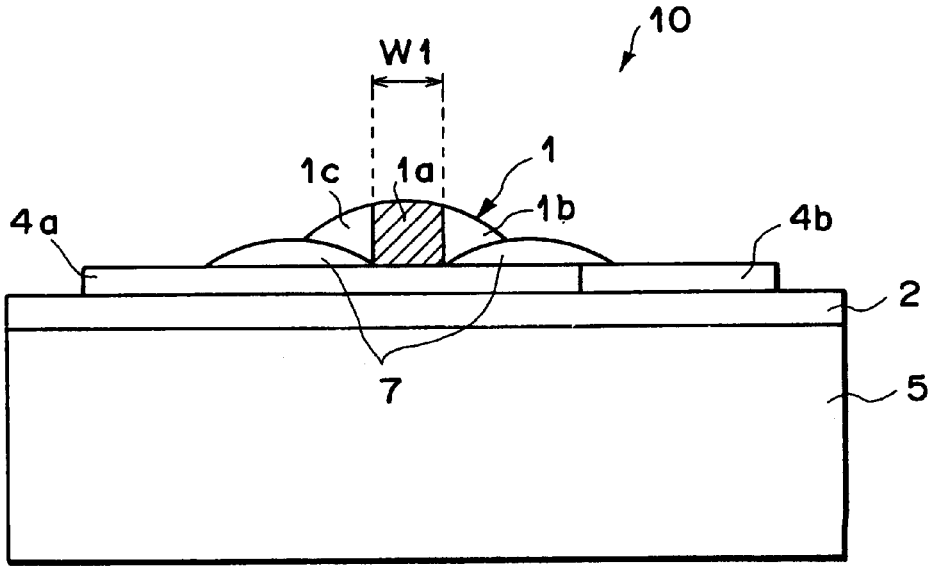
FIG. 2 is a cross-sectional view taken along line A—A in FIG. 1.
Figure 5:
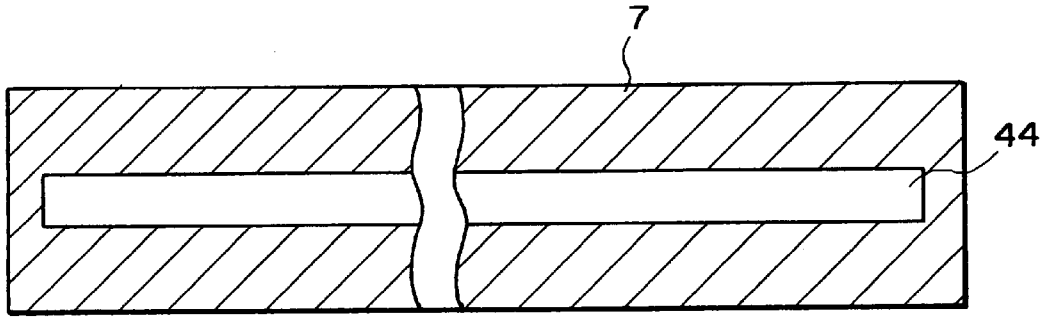
FIG. 5 is a plan view showing the electrical insulating layer.
Figure 7:
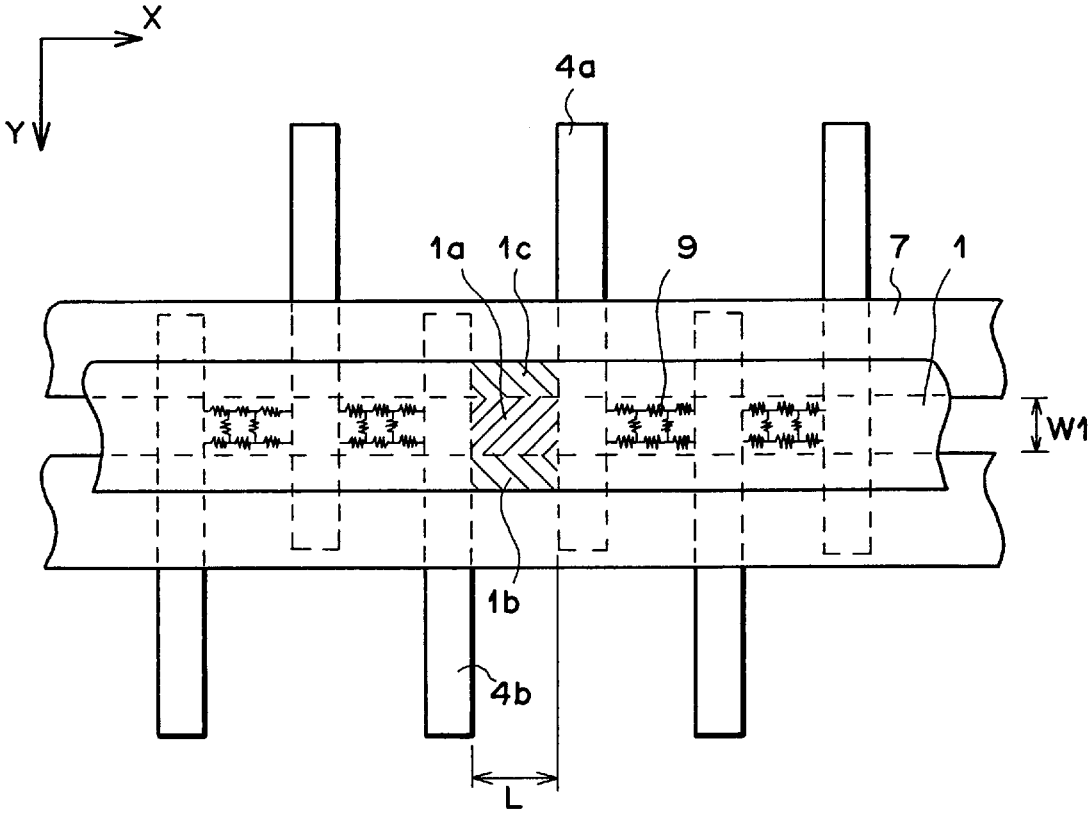
FIG. 7 is a view showing the heater elements or the heat generating areas of the thermal head shown in FIG. 1.
Figure 8:
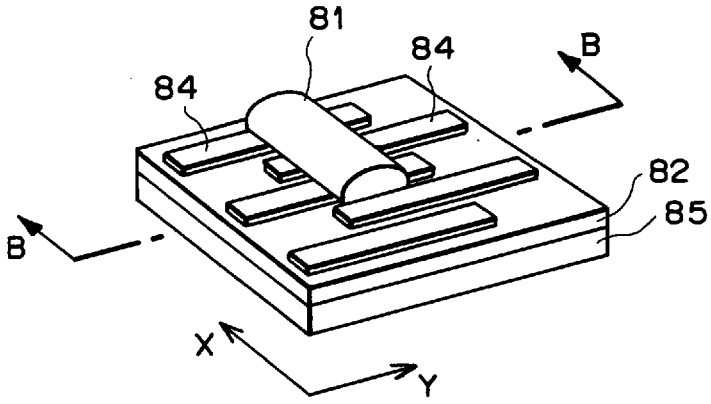
FIG. 8 is a perspective view showing the conventional thick film type thermal head.
Figure 9:
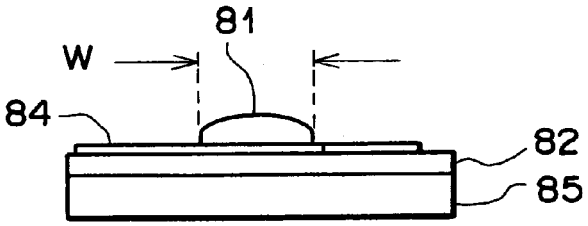
FIG. 9 is a cross-sectional view taken along line B—B in FIG. 8.
Figure 10:
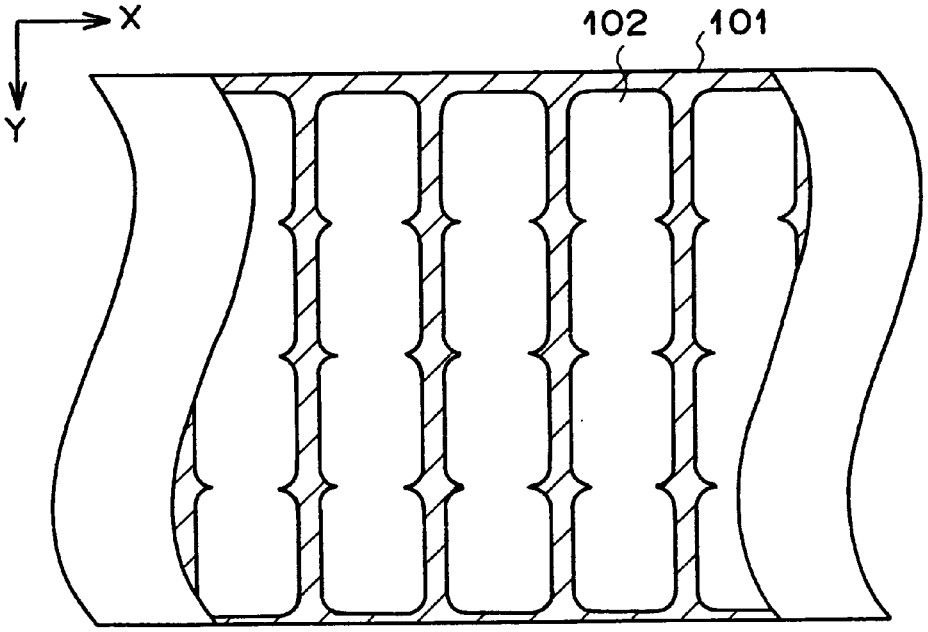
PRIOR ART FIG. 10
FIG. 10 is a schematic view showing perforations which are merged with each other in the sub-scanning direction.
Figure 11:
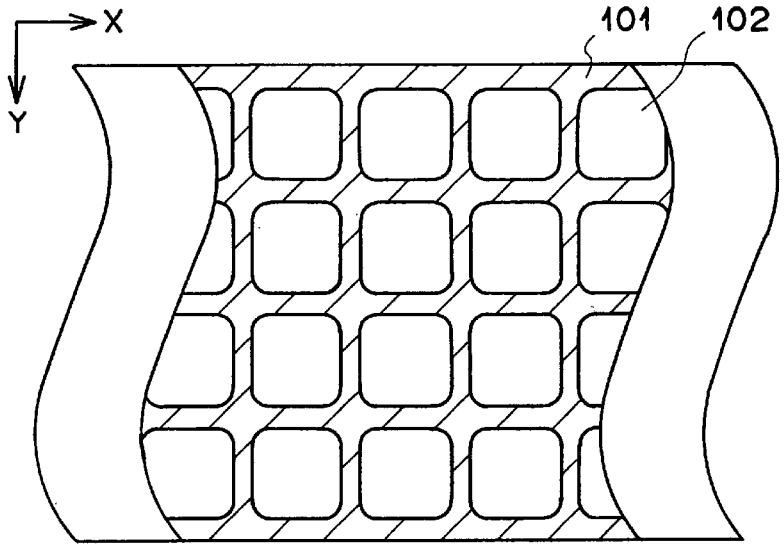
FIG. 11 is a schematic view showing a regular stencil in which perforations are discrete, and FIG. 12 a showing the heater elements or the heat generating areas of the conventional thermal head shown in FIG. 8.
Figure 12:
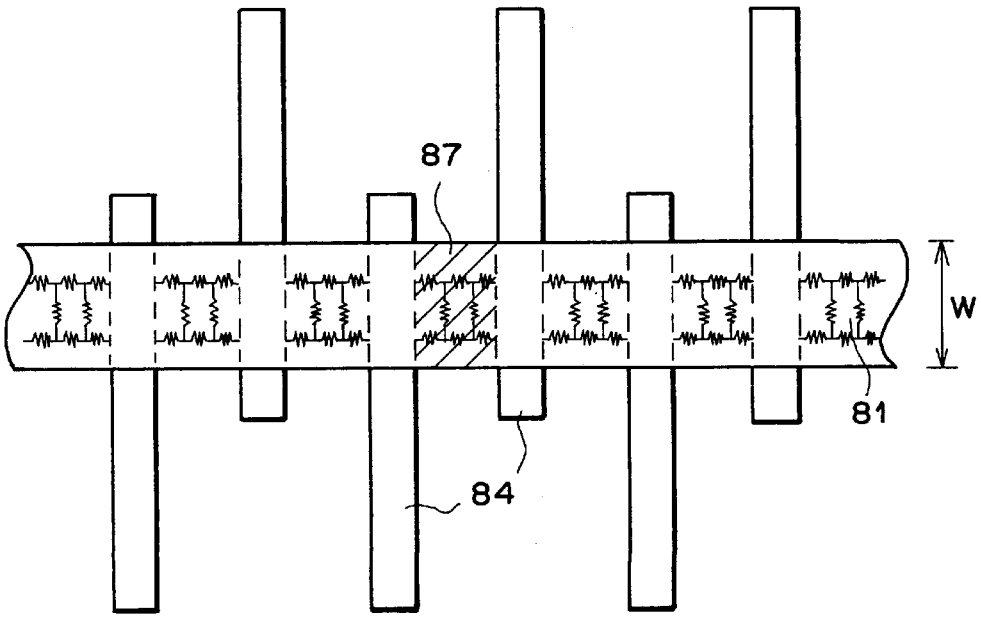

In FIG. 1, a thick film type thermal head 10 in accordance with an embodiment of the present invention comprises a ceramic substrate 5, a heat insulating layer 2 formed on the ceramic substrate 5, a plurality of first and second electrodes 4*a* and 4*b* alternately formed on the heat insulating layer 2 at predetermined intervals, and an electric heater strip 1 formed over the electrodes 4*a* and 4*b* to intersect the electrodes 4*a* and 4*b* in contact alternately with the electrodes 4*a* and 4*b*. The direction in which the electric heater strip 1 extends is the main scanning direction X and each of the parts between adjacent first and second electrodes 4*a* and 4*b* forms a heater element, whereby a heater element array extending in the main scanning direction X is formed. An electrical insulating layer 7 having an elongated central opening 44 as shown in FIG. 5 is formed between the electrodes 4*a* and 4*b* and the electric heater strip 1 so that the heater strip 1 is in electrical contact with the electrodes 4*a* and 4*b* only in the area 1*a* (FIG. 2) in alignment with the central opening 44 of the electrical insulating layer 7 and is not in electrical contact with the electrodes 4*a* and 4*b* in the areas 1*b* and 1*c* where the heater strip 1 overlaps the electrical insulating layer 7. That is, the heater elements generate heat only in the area 1*a* when energized through the first and second electrodes 4*a* and 4*b* as shown in FIG. 7, and the width W1 of each heater element or each heat generating area is made smaller than the width of the heater strip 1 by the electrical insulating layers 7 as clearly shown in FIG. 2.

The heat insulating layer 2 may be of any material so long as it can insulate heat and it chemically matches the heater strip 1, and may be, for instance, of glass. Preferably the heat insulating layer 2 is 40 to 100 $\mu$m in thickness. The first and second electrodes 4*a* and 4*b* may be of various suitable materials such as copper, silver, gold and the like. The electrodes 4*a* and 4*b* are generally 0.5 to 5 $\mu$m in thickness. Though not shown, the surfaces of the heater strip 1 and the first and second electrodes 4*a* and 4*b* are coated with wear-resistant layer (e.g., glass layer 2 to 20 $\mu$m thick). The electrical insulating layer 7 is of glass and 1 to 20 $\mu$m in thickness.

The steps of manufacturing the thermal head 10 of this embodiment will be described with reference to FIGS. 3 to 6, hereinbelow.

Figure 3:
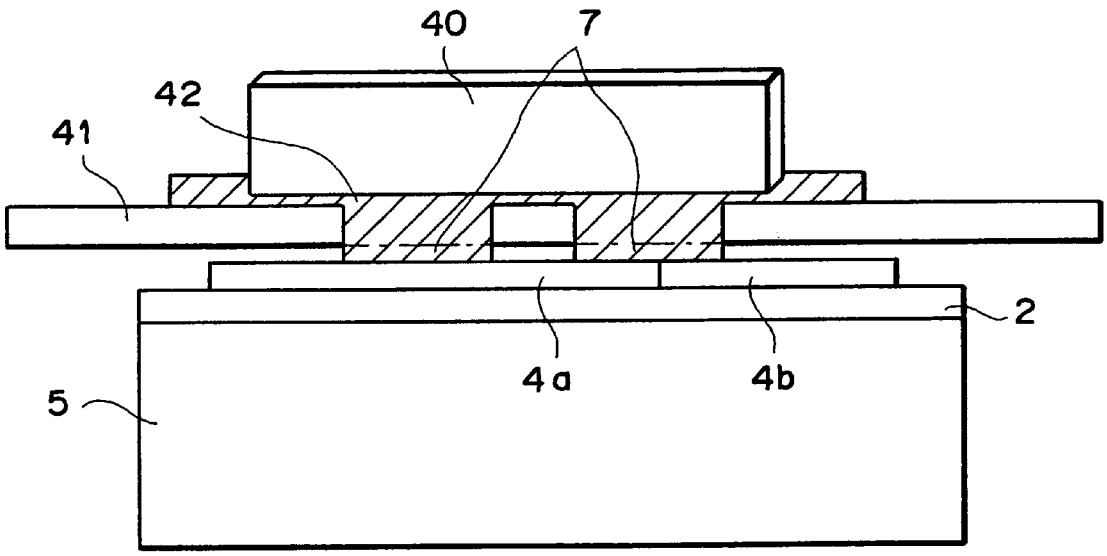
FIG. 3 is a view showing the step of forming the electrical insulating layer on the electrodes.
Figure 4:
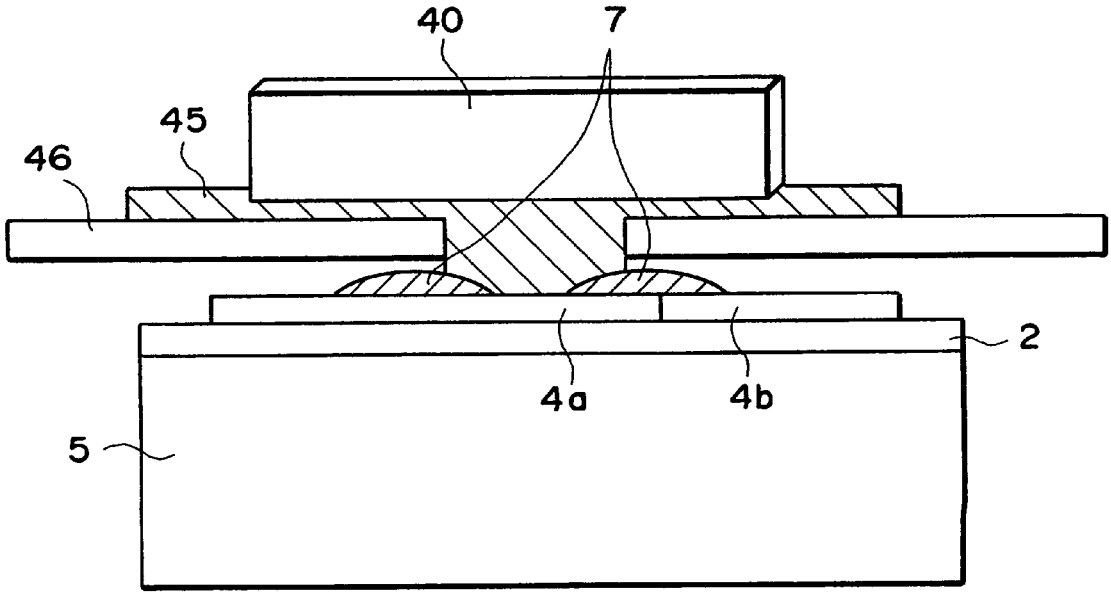
FIG. 4 is a view showing the step of forming the electric heater strip on the electrical insulating layer.
Figure 6:
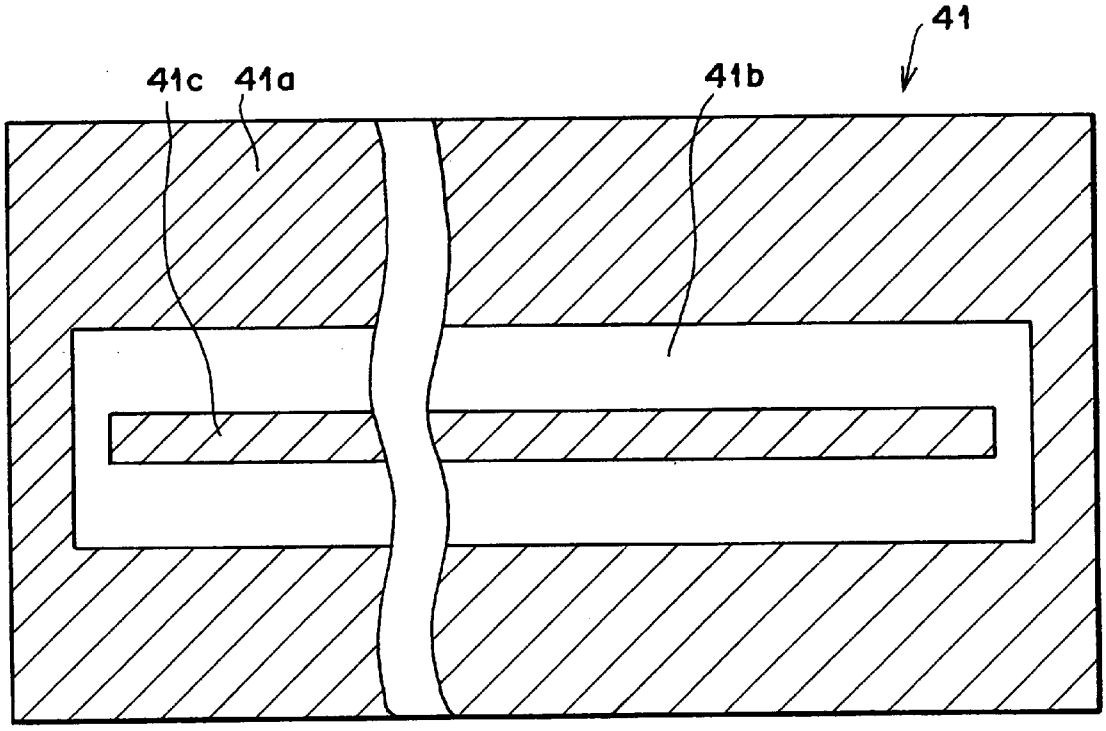
FIG. 6 is a plan view showing the screen printing plate for forming the electrical insulating layer.

The first and second electrodes 4*a* and 4*b* are first formed on the heat insulating layer 2 and the electrical insulating layer 7 is formed on the first and second electrodes 4*a* and 4*b* in the manner shown in FIG. 3. When forming the electrical insulating layer 7, a screen printing plate 41 of metal such as shown in FIG. 6 is used. As shown in FIG. 6, the screen printing plate 41 comprises a peripheral mask portion 41*a* and an elongated central mask portion 41*c* which are not permeable to molten glass 42 (FIG. 3) and a meshed portion 41*b* which is permeable to molten glass 42, is substantially rectangular in shape and circumscribes the central mask portion 41*c*. The central mask portion 41*c* is for forming the central opening 44 of the electrical insulating layer 7. As shown in FIG. 3, the screen printing plate 41 is placed on the ceramic substrate 5, on which the heat insulating layer 2 and the first and second electrodes 4*a* and 4*b* have been formed, so that the central mask portion 41*c* and the meshed portion 41*b* extend across the first and second electrodes 4*a* and 4*b*, and then molten glass 42 is placed over the screen printing plate 41 to cover the meshed portion 41*b*. Then the molten glass 42 is squeezed into the meshed portion 41*b* toward the ceramic substrate 5 by a squeegee 40, whereby an electrical insulating layer 7 is formed on the first and second electrodes 4*a* and 4*b* with a part of the electrodes 4*a* and 4*b* exposed through the central opening 44. Thereafter, a screen printing plate 46 having an elongated meshed portion for forming the heater strip 1 is placed on the substrate 5 over the electrical insulating layer 7 so that the elongated meshed portion is positioned above the central opening 44 of the electrical insulating layer 7 as shown in FIG. 4. Then heat resistor paste 45 is placed on the screen printing plate 46 and is squeezed into the meshed portion by the squeegee 40, whereby the heater strip 1 is formed on the electrical insulating layer 7 and the central opening 44 of the layer 7. Though the heater strip 1 is formed wider than the central opening 44 of the insulating layer 7, the heater strip 1 is in electrical contact with the electrodes 4*a* and 4*b* only through the central opening 44 of the insulating layer 7 as described above. The meshed portion of the screen printing plate 46 for forming the heater strip 1 may be rougher than the meshed portion 41*b* of the screen printing plate 41 for forming the electrical insulating layer 7.

As shown in FIG. 7, when power is supplied through adjacent first and second electrodes 4*a* and 4*b*, the part of the heater strip 1 between the electrodes 4*a* and 4*b* generates heat. However, in the thermal head 10 of this embodiment, only the area 1*a* of the heater strip 1 in electrical contact with the electrodes 4*a* and 4*b* generates heat and areas 1*b* and 1*c* of the heater strip 1 electrically isolated from the electrodes 4*a* and 4*b* do not generate heat. That is, the effective width of the heater strip 1 is narrowed by the electrical insulating layer 7 to W1 which is substantially equal to the width of the central opening 44 of the insulating layer 7. In FIG. 7, reference numeral 9 denotes a circuit equivalent to each of heater elements or heat generating areas in electrical resistance.

Though, in the embodiment described above, the width W1 of each heater element is larger than the length L of each heater element (the distance between adjacent first and second electrodes 4*a* and 4*b*), the latter may be larger than the former.

Though, in the embodiment described above, the insulating layer 7 is disposed on opposite sides of the heater strip 1 to narrow the width of the heater elements from both sides of the strip 1, the insulating layer 7 may be disposed on only one side of the heater strip 1 to narrow the width of the heater elements from one side of the strip 1. Further, though, in the embodiment described above, the parts of the insulating layer 7 on opposite sides of the heater strip 1 are connected to each other by end portions, the insulating layer 7 may comprise a pair of strips each extending along one side of the heater strip 1.

What is claimed is:

1. A thermal head for thermally perforating a stencil material in an imagewise pattern to make a stencil comprising an electric heater strip extending in a first direction, and a plurality of first and second electrodes which are alternately disposed spaced from each other in the first direction and extend across the heater strip in contact therewith, the parts of the heater strip between adjacent first and second electrodes forming heater elements, and the thermal head being moved along the stencil material in a second direction intersecting the first direction while selectively energizing the heater elements through the first and second electrodes, wherein the improvement comprises that an electrical insulating layer is disposed between the first and second electrodes and the heater strip at least on one side of the heater strip so that the width of the electrical contact area between the first and second electrodes and the heater strip becomes smaller than the width of the heater strip thereof.

2. A thermal head as defined in claim 1 in which the electrical insulating layer is disposed on each sides of the heater strip to narrow the electrical contact area from opposite sides of the heater strip.

3. A thermal head as defined in claim 1 in which the electrical insulating layer is disposed so that the width of the electrical contact area between the first and second electrodes and the heater strip becomes smaller than the perforating pitch in the second direction.

* * * * *